United States Patent [19]

Davis et al.

[11] 4,413,849

[45] Nov. 8, 1983

[54] TOOL-OPERATED FLUSH-MOUNTABLE LATCH

[75] Inventors: Edwin W. Davis, Medina; Jack A. Braun, Cleveland, both of Ohio

[73] Assignee: The Eastern Company, Cleveland, Ohio

[21] Appl. No.: 215,567

[22] Filed: Dec. 15, 1980

Related U.S. Application Data

[63] Continuation-in-part of Ser. No. 124,749, Feb. 26, 1980, abandoned.

[51] Int. Cl.[3] ..... E05C 3/04

[52] U.S. Cl. ..... 292/229

[58] Field of Search ..... 292/229, 129, 113, 197, 292/224, DIG. 31; 70/208

[56] References Cited

U.S. PATENT DOCUMENTS

| | | | |
|---|---|---|---|
| 2,476,268 | 7/1949 | Beck et al. | 292/229 |
| 2,594,940 | 4/1952 | Levine | 292/129 X |
| 2,639,178 | 5/1953 | Hogan | 292/229 |
| 2,655,027 | 10/1953 | Lynxwiler | 292/DIG. 31 X |
| 2,717,976 | 9/1955 | Cudney | 292/229 |
| 3,240,523 | 3/1966 | Heimann | 292/229 X |
| 3,250,558 | 5/1966 | McClintock | 292/229 |
| 3,884,056 | 5/1975 | East et al. | 292/197 X |
| 4,177,656 | 12/1979 | Davis | 292/229 X |
| 4,268,077 | 5/1981 | Bohleen et al. | 292/DIG. 31 X |

*Primary Examiner*—Richard E. Moore

*Attorney, Agent, or Firm*—David A. Burge

[57] ABSTRACT

A tool-operated latch has a body which is mountable on the back side of a door panel adjacent an elongate opening and a hole formed through the door panel. An elongate latch lever is pivotally carried by the body and is movable between a latched position wherein the latch lever is nested with respect to the elongate door opening, and an unlatched position wherein the latch lever is extended with respect to the elongate door opening. A tool-operable actuator is journaled by the door panel hole and by the latch body, and is movable by a specially configured tool between locked and unlocked positions. A pawl is pivotally carried by the body for movement between a retaining position wherein it engages the latch lever to releasably retain the latch lever in its nested, latched position, and a releasing position wherein the pawl releases the latch lever thereby permitting the latch lever to be moved to its unlatched, extended position. The tool-operable actuator provides a cam member which cooperates with the pawl to effect movement of the pawl from its retaining position to its releasing position as the actuator is moved from its locked position to its unlocked position.

16 Claims, 11 Drawing Figures

TOOL-OPERATED FLUSH-MOUNTABLE LATCH

CROSS-REFERENCE TO RELATED APPLICATION

The present application is a continuation-in-part of application Ser. No. 124,749 filed Feb. 26, 1980, now abandoned.

BACKGROUND OF THE INVENTION

1. Field of the Invention

The present invention relates generally to a latch of the type which is well adapted for use on electrical equipment enclosures, access panels and the like where a key-operated lock is not required but where a specially configured tool is desirably required in order to release the latch.

2. Prior Art

Flush-mountable latch assemblies of the type employing a housing having a forwardly-facing recess, an elongate latch lever pivotally connected to the housing, and a pawl for releasably retaining the latch lever in its latched position are known. Previously proposed latches of this type have been provided with an actuator button which is formed integrally with the pawl and which is engaged by an operator's hand for movement to a releasing position wherein the pawl no longer retains the latch member in its latched position. Latches of this type have not provided the degree of security desired in certain electrical panel installations, access panel applications and the like where it is preferable to require that a specially configured tool be employed to effect latch release.

While tool-operated latches of various types have been proposed, prior proposals have not included the provision of a lever-action, flush-mountable latch wherein a latch lever is releasably retained in its latched position by a tool-operated locking mechanism.

SUMMARY OF THE INVENTION

The present invention overcomes the foregoing and other drawbacks of prior art proposals by providing a novel and improved, flush-mountable, tool-operated, lever-acting latch formed from simply configured, rugged components.

In accordance with the preferred practice of the present invention, a tool-operated latch includes a body having wall portions which define an elongate, forwardly-facing recess. Mounting formations are provided on opposite sides of the recess for mounting the body on a door panel with the forwardly-facing recess aligned with an elongate opening formed through the door panel. An elongate latch lever is pivotally connected to the body and has strike-engaging and operating formations. The strike-engaging formation is movable between a latched position wherein it is engageable with a strike for retaining the door panel in a closed position, and an unlatched position wherein it permits the door panel to move from a closed position to an open position. The operating formation takes the form of an elongate arm which is movable between a nested position relative to the forwardly-facing recess and an extended position relative to the recess. The operating formation is configured to reside in its nested position when the strike-engaging formation is in its latched position, and resides in its extended position when the strike-engaging formation is in its unlatched position. A pawl member is pivotally connected to the body for movement between a retaining position, wherein it is engageable with the latch lever to releasably retain the latch lever with its formations in their nested, latched positions, and a releasing position wherein the pawl releases the latch lever thereby permitting the latch lever formations to be moved to their unlatched, extended positions. A tool-operable actuator is connected to the body for movement between locked and unlocked positions. The actuator includes a tool-receiving formation for receiving a specially configured tool to move the actuator. The actuator includes a cam member which cooperates with the pawl to permit movement of the pawl to its retaining position when the actuator is in its locked position, and which effects movement of the pawl to its releasing position when the actuator is moved to its unlocked position.

In a less preferred embodiment, three springs each operate on a separate one of the latch lever, the pawl and the actuator for biasing the latch lever away from its latched, nested position toward its unlatched, extended position, for biasing the pawl away from its releasing position toward its retaining position, and for biasing the actuator away from its unlocked position toward its locked position. In this embodiment, the actuator carries a pair of abutment surfaces which are selectively engageable with a body-carried stop formation to define the locked and unlocked positions of the actuator.

In a preferred embodiment only two springs are required. A first operates on the latch lever. A second operates on the pawl. The cam member is configured to be engaged at all times by the pawl and is biased by the second spring toward a position wherein it serves to retain the actuator in its locked position. The actuator may be rotated in either of two directions toward unlocked positions, and the cam member is engageable with a housing-carried stop to define these two unlocked positions.

A feature of a latch embodying the preferred practice of the present invention lies in the simplicity of its construction and in the rugged, dependable configuration of its components. The body is formed as a sheet metal stamping and is of one-piece construction. The latch lever, the pawl and the actuator, take the form of simply configured parts that can be formed at minimal expense. The springs which assist in positioning the movable components are of simple configuration and are easily installed on the body at the same time the movably mounted members are mounted on the body.

In the less preferred embodiment, the actuator must be rotated by the tool in a given direction to unlatch the latch. In the preferred embodiment, the actuator may be rotated in either of two directions to effect unlatching.

These and other features and a fuller understanding of the invention may be had by referring to the following description and claims taken in conjunction with the accompanying drawings.

DESCRIPTION OF THE PREFERRED EMBODIMENTS

Figure 1:
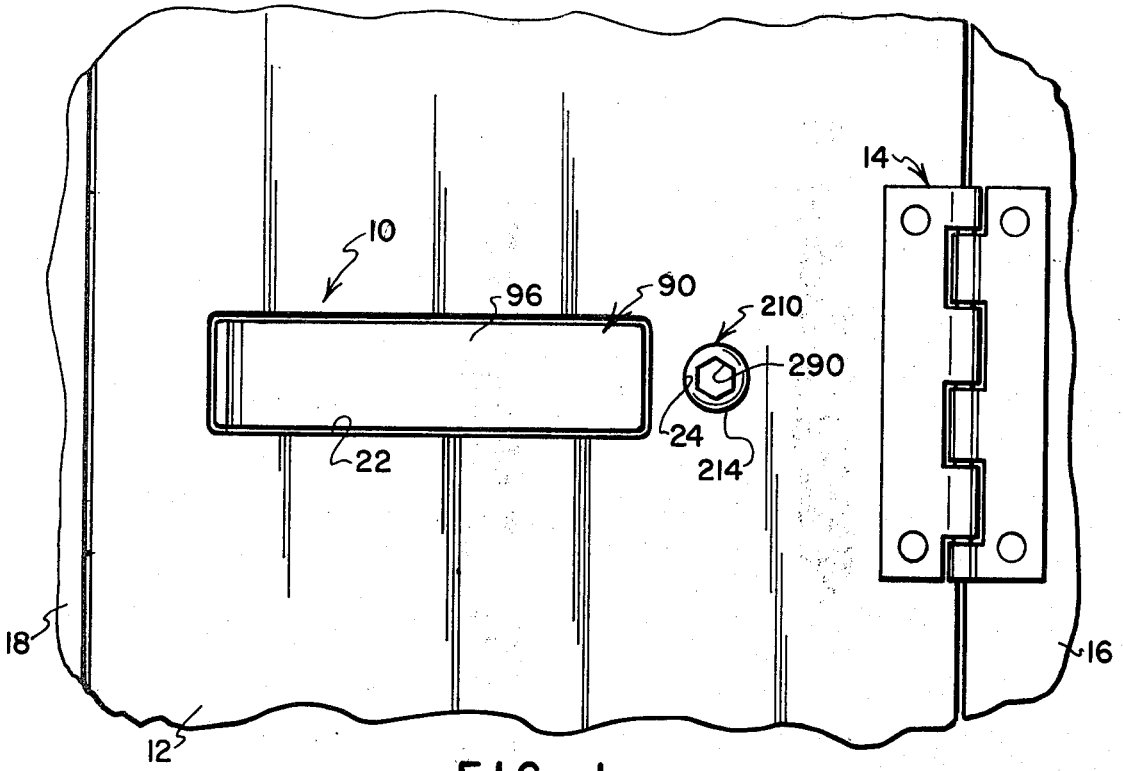
FIG. 1 is a front side elevational view of a hinged door panel with a less preferred embodiment of a flush-mountable, tool-operable latch incorporating features of the present invention mounted thereon, with components of the latch being latched.
Figure 2:
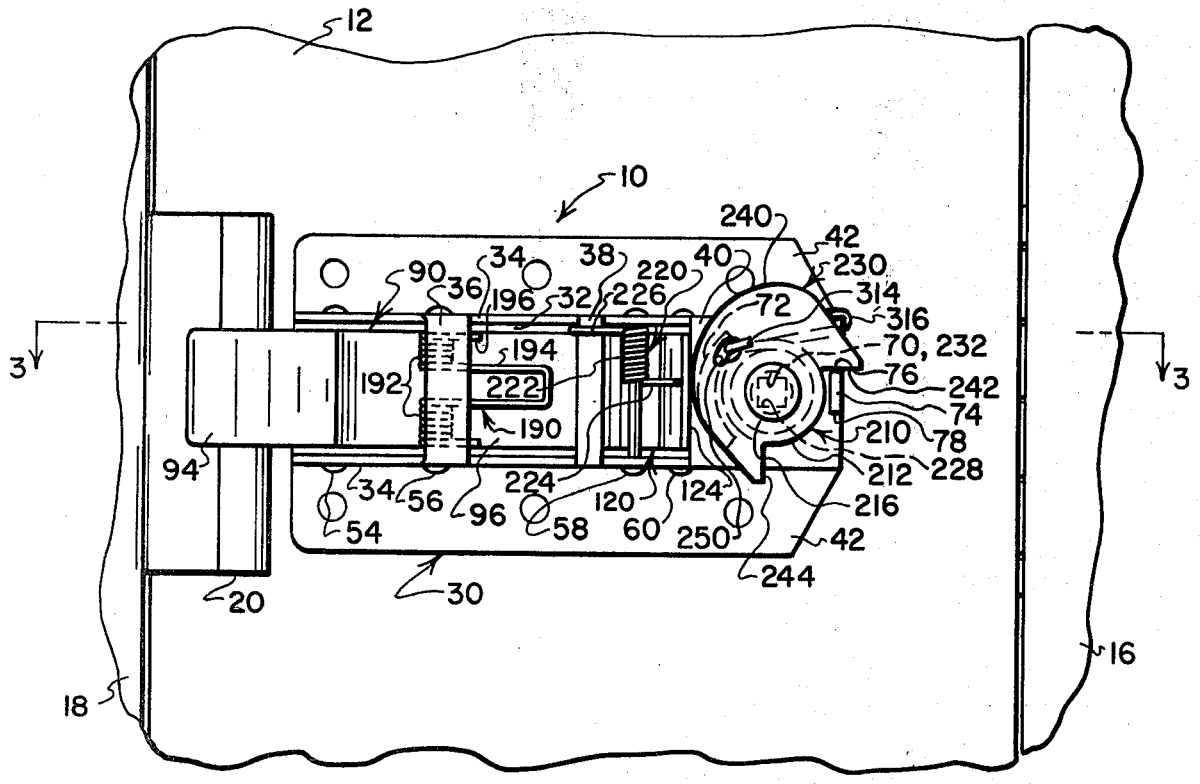
FIG. 2 is a rear side elevational view of the door panel and latch of FIG. 1 with the components of the latch being positioned as shown in FIG. 1.
Figure 3:
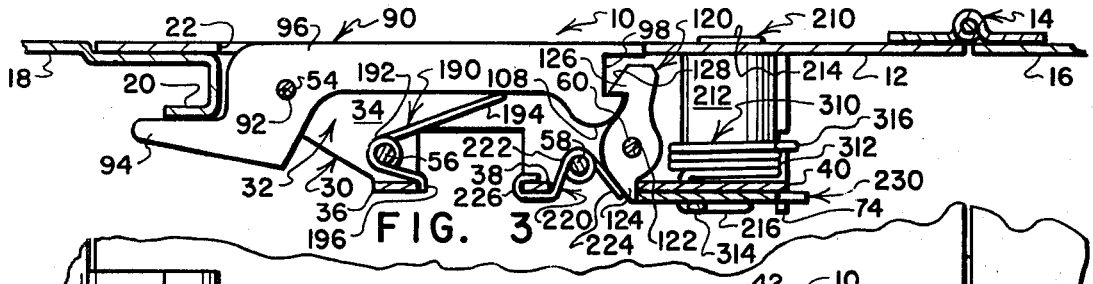
FIG. 3 is a sectional view as seen from a plane indicated by a line 3—3 in FIG. 2.

Referring to FIGS. 1–3, a less preferred embodiment of a flush-mountable, tool-operable latch incorporating features of the present invention is indicated generally by the numeral 10. The latch 10 is shown mounted on a door panel 12. A hinge 14 of conventional configuration pivotally connects the right side portion of the door panel 12 to a door frame member 16. A door frame member 18 is provided with a strike formation 20 which underlies a portion of the left side region of the door panel 12. A substantially rectangular opening 22 and a hole 24 are formed through the door panel 12. The door panel 12 is shown in its closed position in FIGS. 1–3, and is shown in an open position in FIG. 6.

The latch 10 includes a body 30 which has side and back wall portions that cooperate to define a forwardly-facing recess 32. The body 30 is secured to the back face of the door panel 12 and is positioned with respect to the door panel 12 such that the recess 32 is aligned with the rectangular opening 22. A latch lever 90, a pawl 120, and a tool-operable actuator 210 are movably connected to the body 30. The latch lever 90 is movable between a latched position shown in FIGS. 1–3 and an unlatched position shown in FIG. 6. The pawl 120 is movable between a retaining position shown in FIG. 3 and a releasing position shown in FIG. 5. The tool-operated actuator 210 is movable between a locked position shown in FIGS. 1–3 and an unlocked position shown in FIGS. 4 and 5. Three torsion coil springs 190, 220, 310 operate on the latch lever, the pawl and the actuator 90, 120, 210. The spring 190 biases the latch lever 90 away from its latched position toward its unlatched position. The spring 220 biases the pawl 120 away from its releasing position toward its retaining position. The spring 310 biases the actuator 210 away from its unlocked position toward its locked position.

The latch body 30 is a one-piece member formed as a stamping from a sheet of steel. The body 30 has side wall portions 34 which cooperate with back wall portions 36, 38, 40 to define the forwardly-facing recess 32. Mounting flanges 42 extend along opposite sides of the recess 32. The flanges 42 may be spot-welded to the door panel 12 or otherwise secured thereto by suitable fasteners (not shown).

Figure 5:
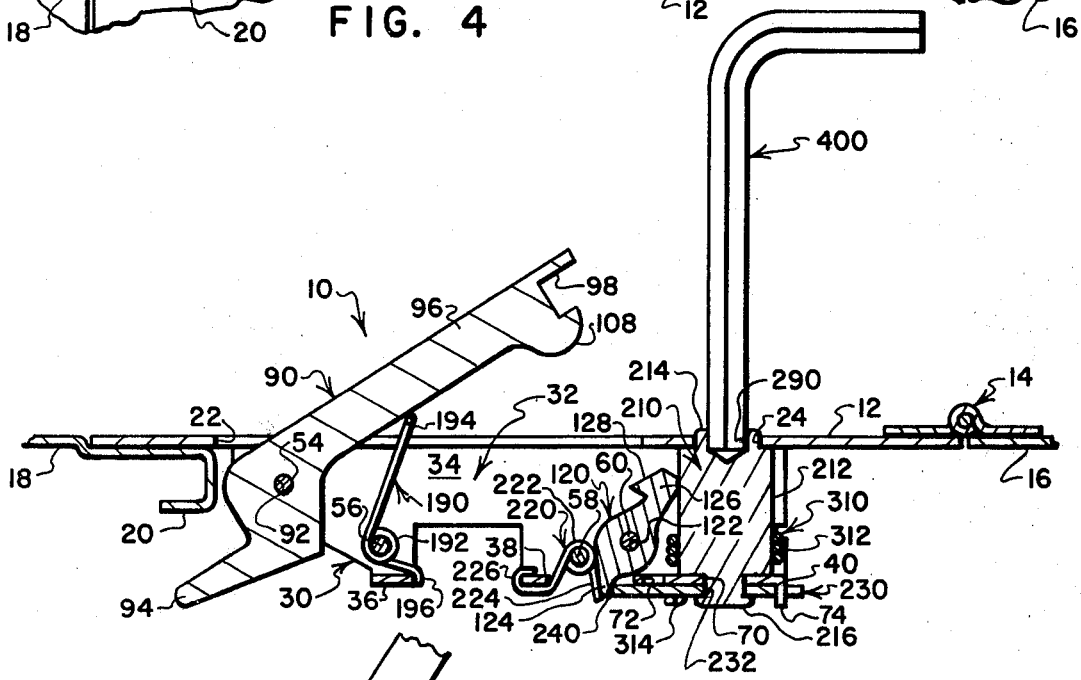
FIG. 5 is a sectional view as seen from a plane indicated by a line 5—5 in FIG. 4, and showing a tool operating the latch.
Figure 6:
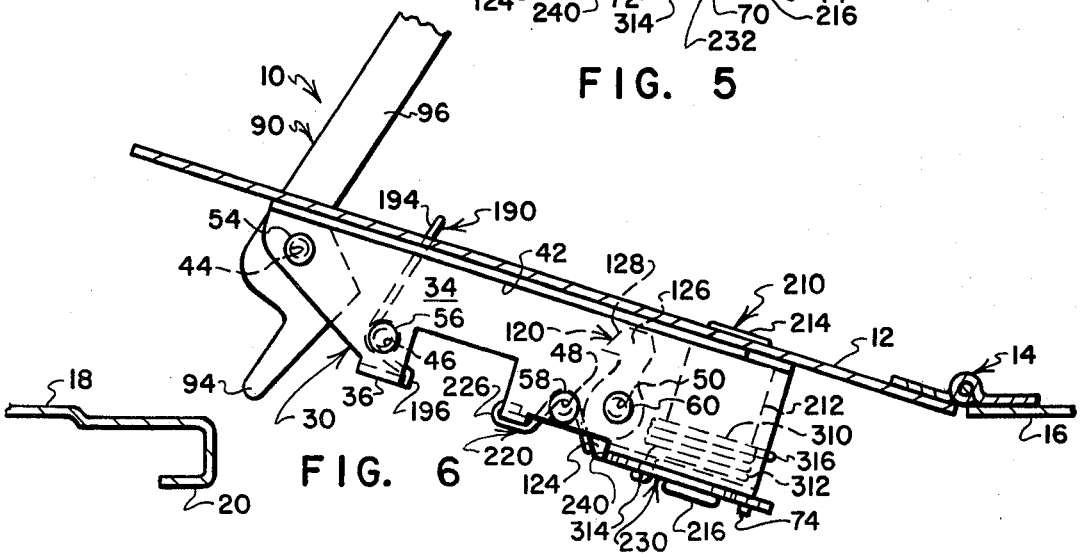
FIG. 6 is a bottom plan view of the door panel and latch with the door panel pivoted to an open position, with the tool removed, and with the latch components unlatched.

Referring to FIG. 6, four pairs of aligned holes, 44, 46, 48, 50 are formed through the side wall portions 34. Referring to FIGS. 2–6, spaced, parallel shafts 54, 56, 58, 60 have their opposite end regions journaled by the holes 44, 46, 48, 50 and have central portions which extend across the recess 32. The shafts 54, 60, pivotally mount the latch lever 90 and the pawl 120 on the body 30. The shafts 56, 58 support the springs 150, 220 as will be described in greater detail. Opposite ends of the shafts 54, 56, 58, 60 are crimped to form enlarged heads which will retain these shafts in place on the body 30.

Figure 4:
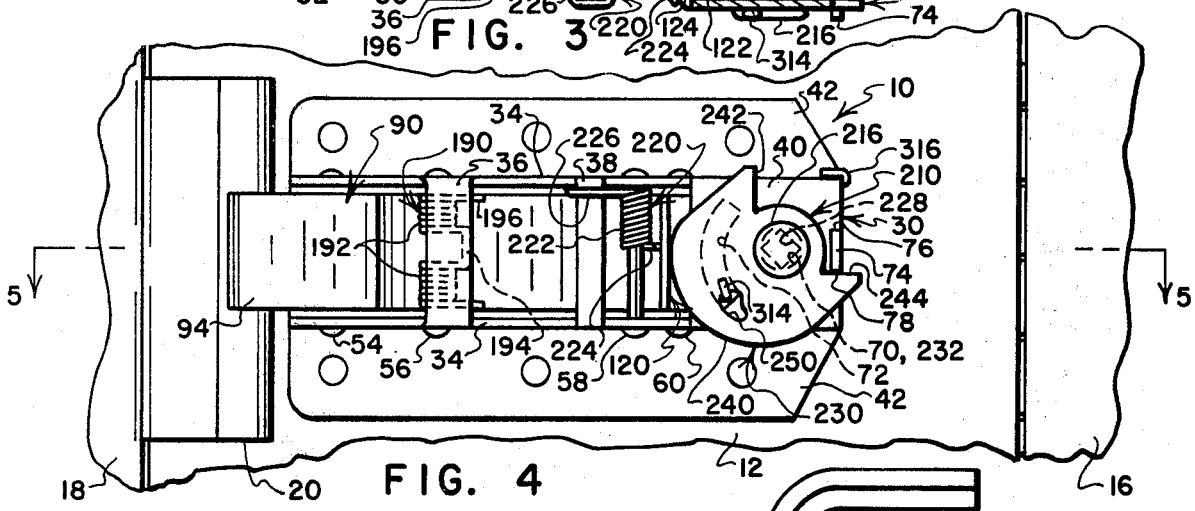
FIG. 4 is a rear side elevational view similar to FIG. 2 but with the components of the latch being positioned in an attitude wherein the latch lever is moving from its latched position toward its unlatched position.

Referring to FIGS. 2, 4 and 5, an actuator mounting hole 70 and a curved slot 72 are formed through the back wall portion 40. A rearwardly turned projection 74 is formed integrally with the back wall portion 40 and has opposed side surfaces 76, 78 which serve as abutments to limit the travel of the tool-operated actuator 210, as will be described in greater detail.

The latch lever 90 is preferably formed as a die-cast member to provide an accurately dimensioned, elongate part at minimal expense. A mounting hole 92 is formed transversely through the lever 90. The shaft 54 extends through the hole 92 and pivotally mounts the lever 90 on the body 30. The lever 90 has a relatively short strike-engaging nose formation 94 which extends substantially leftwardly relative to the mounting hole 92, and a relatively long operating formation 96 which extends substantially rightwardly relative to the mounting hole 92. A pawl-receiving notch 98 is formed near the right end of the operating formation 96.

The latch lever 90 is movable between a latched attitude shown in FIGS. 1–3, and an unlatched attitude shown in FIG. 6. When the lever 90 is in its latched attitude, the strike-engaging nose formation 94 extends leftwardly with respect to the body 30 to a position engaging and underlying the strike formation 20 whereby the door panel 12 is releasably retained in its closed position. When the strike-engaging formation 94 is in its latched position, the operating formation 96 is nested with respect to the opening and recess 22, 32. When the lever 90 is in its unlatched attitude, the strike-engaging formation 94 is withdrawn with respect to the strike 20, thereby permitting the door panel 12 to be pivoted to an open position, as shown in FIG. 6. When the strike-engaging formation 94 is in its unlatched position, as shown in FIG. 6, the operating formation 96 is extended with respect to the opening and recess 22, 32.

The spring 190 has coiled portions 192 which are reeved around the shaft 56, a central portion 194 which is engageable with the back side of the operating formation 96, and end portions 196 which engage the back wall portion 36. The spring 190 serves to bias the latch lever 90 away from a position wherein the formations 94, 96 are latched and nested, toward a position where the formations 94, 96 are unlatched and extended.

The pawl 120 has a mounting hole 122 extending transversely therethrough. The shaft 60 extends through the hole 122 and pivotally mounts the pawl 120 on the body 30. Abutment and tooth formations 124, 126 are provided near opposite ends of the pawl 120, on opposite sides of the mounting hole 122. The abutment formation 124 extends rearwardly and projects through a back wall opening defined between the back wall portions 38, 40. The tooth formation 126 is configured to be receivable within the pawl-receiving notch 98, as is best seen in FIG. 3.

The pawl 120 is movable between a retaining position, shown best in FIG. 3, and a releasing position, shown best in FIG. 5. When the pawl 120 is in its retaining position, the tooth formation 126 is engageable with the pawl-receiving notch 98 (assuming the latch lever 90 is in its latched, nested position). If the latch lever 90 is not in its latched, nested position, an inclined surface 128 formed on the pawl 120 will cooperate with a rounded surface 108 formed on the latch lever 90 as the latch lever 90 is moved toward its latched, nested position to pivot the pawl 120 clockwise until the latch lever 90 is in its latched, nested position, whereupon the pawl tooth formation 126 is moved, under the influence of the spring 220 into receiving engagement with the notch 98. When the pawl 120 is moved to its releasing position, as shown in FIG. 5, the tooth formation 126 is no longer received within the notch 98, whereupon the latch lever 90 is released to move under the influence of the spring 190 away from its latched, nested position toward its unlatched, extended position.

The spring 220 has a coiled portion 222 which is reeved around the shaft 60, an elongate end portion 224 which is engageable with the abutment formation 124, and an elongate end portion 226 which engages the back wall portion 38. The spring 220 operates to bias the pawl 120 away from its releasing position toward its retaining position.

The tool-operated actuator 210 has a generally cylindrical central portion 212, a reduced-diameter head portion 214, and a mounting projection 216. A cam member 230 is carried on the mounting projection 216. The head portion 214 extends through and is journaled by the door panel hole 24. A tool-receiving formation 290 in the form of a specially configured cavity opens through the outer surface of the head portion 214. While the tool-receiving formation 290 has been illustrated in FIG. 1 of the drawings as comprising a conventional hex-shaped recess capable of receiving a conventional Allen wrench, indicated generally by the numeral 400 in FIG. 5, the tool-receiving formation 290 can take any of a wide variety of configurations as may be desired to receive any of a wide variety of other types of specially configured tools (not shown).

The mounting projection 216 extends through the actuator mounting hole 70, through a hole 232 formed through the cam member 230, and is crimped to provide an enlarged head which will retain the actuator member 210 and the cam member 230 in place relative to the body 30 while permitting the actuator member 210 to rotate about an axis defined by the mounting hole 70. The axis defined by the mounting hole 70 extends substantially orthogonally with respect to the axes of the parallel-extending shafts 54, 56, 58, 60 (i.e., the axis of the hole 70 extends in a plane which perpendicularly intersects the parallel axes of the shafts 54, 56, 58, 60).

The portion of the mounting projection 216 which extends through the mounting hole 70 has a cylindrical outer surface which slip fits within the hole 70. The portion of the mounting projection 216 which extends through the cam member hole is of square configuration, as is the cam member hole 232 (these interfitting squares being indicated by the numeral 228 in FIGS. 2 and 4), whereby a driving connection is formed between the mounting projection 216 and the cam member 230.

The cam member 230 has a curved cam surface 240 which is engageable with the pawl abutment formation 124. A pair of abutment surfaces 242, 244 are formed at opposite ends of the curved surface 240 and are selectively engageable with the body projection 74, as is best seen in FIGS. 2 and 4, to define the extremes of movement of the actuating member 210. When the actuating member 210 is in its locked position, as shown in FIGS. 1–3, the abutment surface 242 engages the body projection 74 and the curved surface 240 permits the pawl 120 to assume its retaining position under the influence of the spring 220. When the actuating member 210 is rotated to its unlocked position, the abutment surface 244 engages the body projection 74 and the curved surface 240 engages the abutment formation 124 causing the pawl 120 to pivot to its releasing position in opposition to the action of the spring 220.

The spring 310 has a coiled portion 312 which is reeved around the cylindrical center portion 212 of the actuator 210. An end portion 314 of the spring 310 extends through the curved back wall slot 72 and through a hole 250 formed in the cam member 230. An opposite end 316 of the spring 310 engages one of the side walls portions 34 to couple the spring 310 to the body 30. The spring 310 biases the actuator 210 away from its unlocked position toward its locked position.

A feature of the latch 10 lies in the manner in which the axis of the actuator 210 is fixed with respect to the door panel 12. One end portion of the actuator 210 is journaled by the body mounting hole 70. The other end region of the actuator member 210 is journaled by the door panel hole 24. This simple and effective mounting system not only fixes the rotation axis of the actuator 210 relative to the door panel 12, but also utilizes the door panel 12 on which the latch 10 is mounted to assist in securely supporting and journaling one end of the actuator 210. When an Allen wrench 400 or other suitably configured tool (not shown) is introduced into the tool-receiving formation 290 or other suitably configured formation (not shown), and is operated to move the actuator 210 from its locked position to its unlocked position, the axis of movement of the actuator 210 does not change relative to the door panel 12.

A further feature of the present invention lies in the manner in which the latch lever 90 and the door panel 12 cooperate to shield the pawl 120 from unauthorized access. When the latch lever 90 is in its latched, nested position, it is closely received within the door panel opening 22 so that the pawl 120 is shielded from unauthorized access.

Referring to FIGS. 7–11, a flush-mountable, tool-operable latch embodying the preferred practice of the present invention is indicated generally by the numeral 410. The latch 410 is shown mounted on a door panel 412. A hinge 414 of conventional configuration pivotally connects the right side portion of the door panel 412 to a door frame member 416. A door frame member 418 is provided with a strike formation 420 which underlies a portion of the left side region of the door panel 412. A substantially rectangular opening 422 and a hole 424 are formed through the door panel 412. The door panel 412 is shown in its closed position in FIGS. 7 and 8, and is shown in an open position in FIG. 11.

The latch 410 includes a body 430 which has side and back wall portions that cooperate to define a forwardly-facing recess 432. The body 430 is secured to the back face of the door panel 412 and is positioned with respect to the door panel 412 such that the recess 432 is aligned with the rectangular opening 422. A latch lever 490, a pawl 520, and a tool-operable actuator 610 are movably connected to the body 430. The latch lever 490 is movable between a latched position shown in FIGS. 7 and 8, and an unlatched position shown in FIG. 11. The pawl 520 is movable between a retaining position shown in FIG. 8 and a releasing position shown in FIG. 10. The tool-operated actuator 610 is movable between a locked position shown in FIGS. 7 and 8, and either of two unlocked positions shown in FIGS. 9 and 10, one of the unlocked positions being shown in solid lines and the other in phantom. Two torsion coil springs 590, 620 operate on the latch lever and the pawl 490, 520. The spring 590 biases the latch lever 490 away from its latched position toward its unlatched position. The spring 620 biases the pawl 520 away from its releasing position toward its retaining position.

The latch body 430 is a one-piece member formed as a stamping from a sheet of steel. The body 430 has side wall portions 434 which cooperate with back wall portions 436, 438, 440 to define the forwardly-facing recess 432. A depending stop formation 441 is provided at the right end of the back wall portion 440, as viewed in FIGS. 7–11. Mounting flanges 442 extend along opposite sides of the recess 432. The flanges 442 may be spot-welded to the door panel 412 or otherwise secured thereto by suitable fasteners (not shown).

Figure 7:
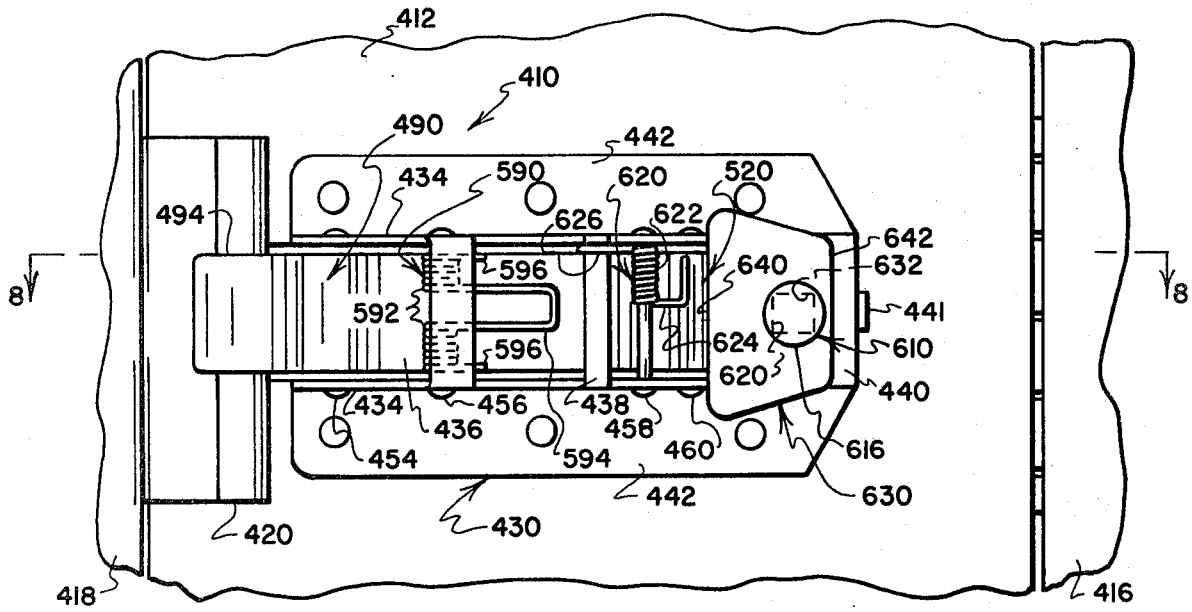
FIG. 7 is a rear side elevational view of the door panel and latch embodying the preferred practice of the present invention, with the components of the latch being latched.
Figure 8:
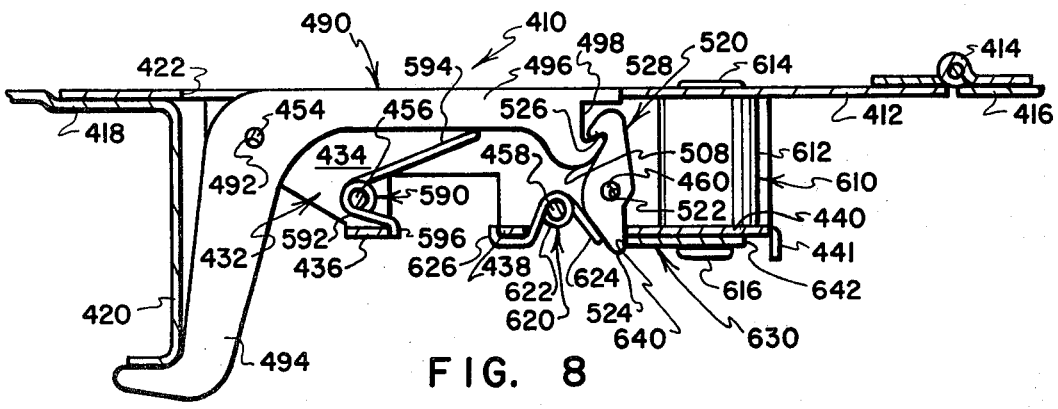
FIG. 8 is a sectional view as seen from a plane indicated by a line 8—8 in FIG. 7.
Figure 9:
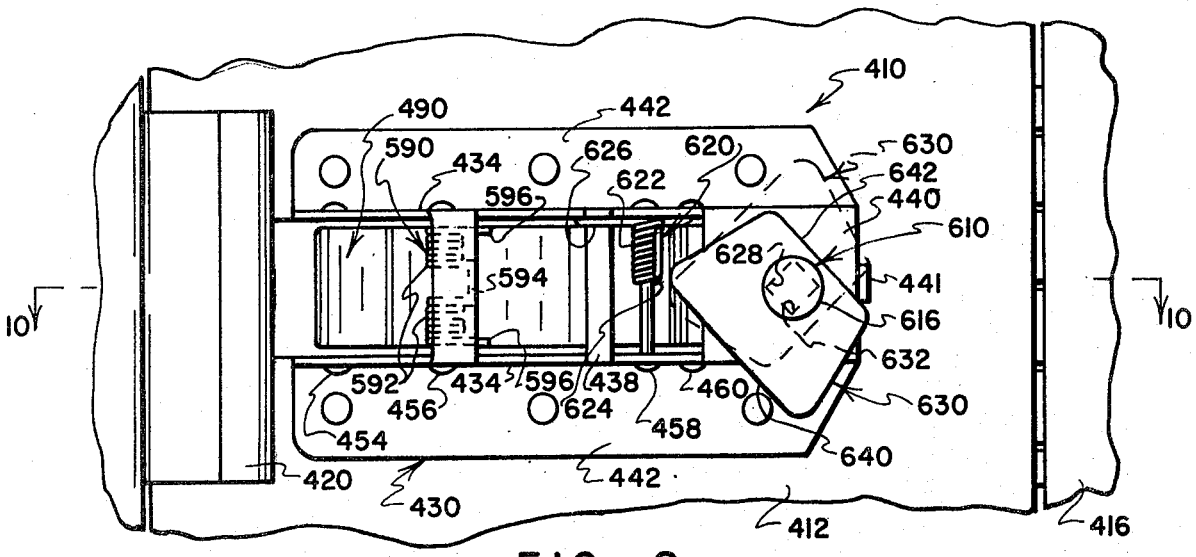
FIG. 9 is a rear side elevational view similar to FIG. 7 but with the components of the latch being positioned in an attitude wherein the latch lever is moving from its latched position toward its unlatched position.
Figure 11:
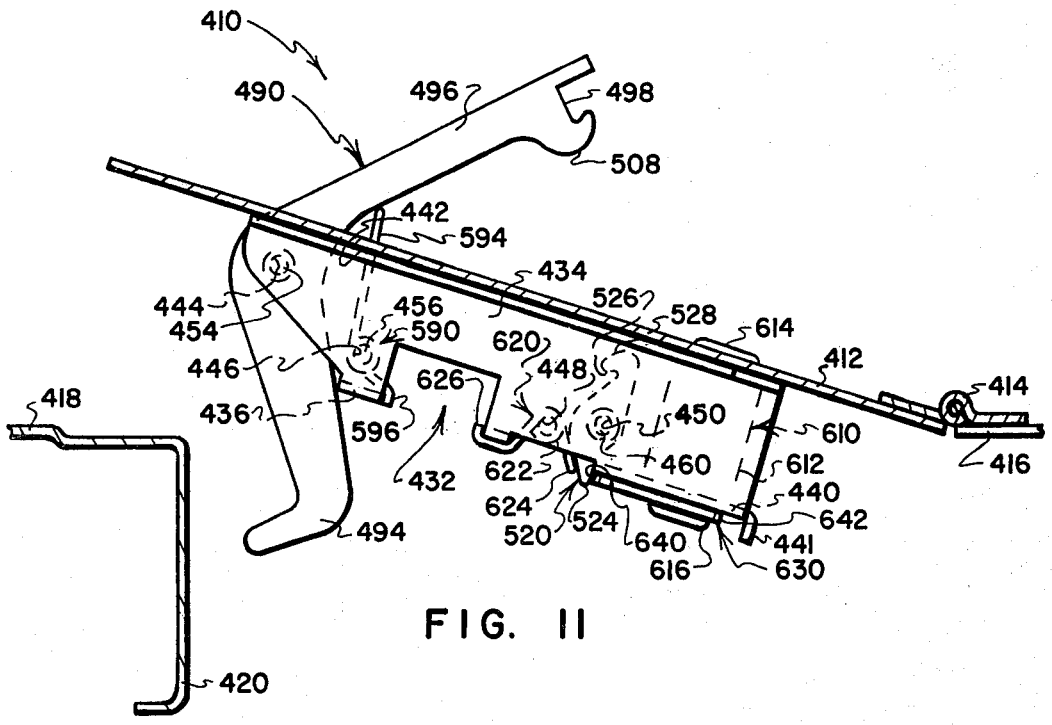

Referring to FIG. 11, four pairs of aligned holes, 444, 446, 448, 450 are formed through the side wall portions 434. Referring to FIGS. 7–9 spaced, parallel shafts 454, 456, 458, 460 have their opposite end regions journaled by the holes 444, 446, 448, 450 and have central portions which extend across the recess 432. The shafts 454, 460, pivotally mount the latch lever 490 and the pawl 520 on the body 430. The shafts 456, 458 support the springs 550, 620 as will be described in greater detail. Opposite ends of the shafts 454, 456, 458, 460 are crimped to form enlarged heads which will retain these shafts in place on the body 430.

Figure 10:
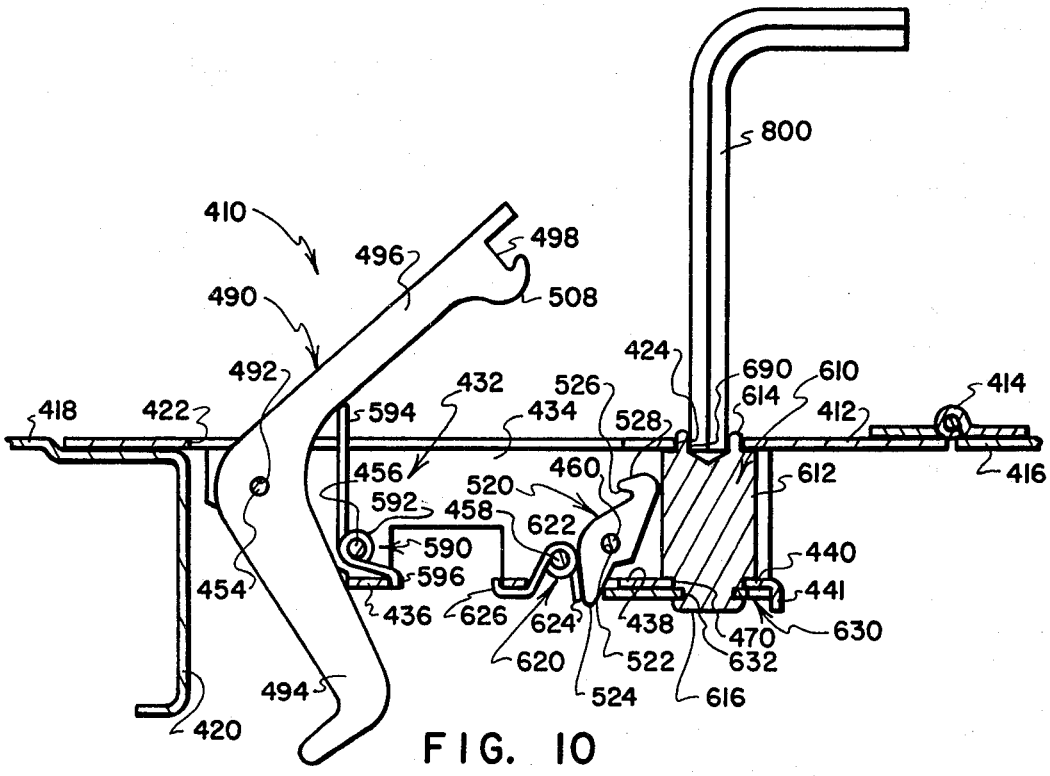
FIG. 10 is a sectional view as seen from a plane indicated by a line 10—10 in FIG. 9, and showing a tool operating the latch; and, FIG. 11 is a bottom plan view of the door panel and latch with the door panel pivoted to an open position, with the tool removed, and with the latch components unlatched.

Referring to FIG. 10, an actuator mounting hole 470 is formed through the back wall portion 440.

The latch lever 490 is preferably formed as an extruded member to provide an accurately dimensioned, elongate part at minimal expense. A mounting hole 492 is formed transversely through the lever 490. The shaft 454 extends through the hole 492 and pivotally mounts the lever 490 on the body 430. The lever 490 has a relatively elongate strike-engaging nose formation 494 which extends substantially leftwardly relative to the mounting hole 492, and a relatively long operating formation 496 which extends substantially rightwardly relative to the mounting hole 492. A pawl-receiving notch 498 is formed near the right end of the operating formation 496.

The latch lever 490 is movable between a latched attitude shown in FIGS. 7 and 8, and an unlatched attitude shown in FIG. 11. When the lever 490 is in its latched attitude, the strike-engaging nose formation 494 extends leftwardly with respect to the body 430 to a position engaging and underlying the strike formation 420 whereby the door panel 412 is releasably retained in its closed position. When the strike-engaging formation 494 is in its latched position, the operating formation 496 is nested with respect to the opening and recess 422, 432. When the lever 490 is in its unlatched attitude, the strike-engaging formation 494 is withdrawn with respect to the strike 420, thereby permitting the door panel 412 to be pivoted to an open position, as shown in FIG. 11. When the strike-engaging formation 494 is in its unlatched position, as shown in FIG. 11, the operating formation 496 is extended with respect to the opening and recess 422, 432, and the strike-engaging formation 494 abuts the back wall portion 436 of the body 430.

The spring 590 has coiled portions 592 which are reeved around the shaft 456, a central portion 594 which is engageable with the back side of the operating formation 496, and end portions 596 which engage the back wall portion 436. The spring 590 serves to bias the latch lever 490 away from a position wherein the formations 494, 496 are latched and nested, toward a position where the formations 494, 496 are unlatched and extended.

The pawl 520 has a mounting hole 522 extending transversely therethrough. The shaft 460 extends through the hole 522 and pivotally mounts the pawl 520 on the body 430. Abutment and tooth formations 524, 526 are provided near opposite ends of the pawl 520, on opposite sides of the mounting hole 522. The abutment formation 524 extends rearwardly and projects through a back wall opening defined between the back wall portions 438, 440. The tooth formation 526 is configured to be receivable within the pawl-receiving notch 498, as is best seen in FIG. 8.

The pawl 520 is movable between a retaining position, shown best in FIG. 8, and a releasing position, shown best in FIG. 10. When the pawl 520 is in its retaining position, the tooth formation 526 is engageable with the pawl-receiving notch 498 (assuming the latch lever 490 is in its latched, nested position). If the latch lever 490 is not in its latched, nested position, an inclined surface 528 formed on the pawl 520 will cooperate with a rounded surface 508 formed on the latch lever 490 as the latch lever 490 is moved toward its latched, nested position to pivot the pawl 520 clockwise until the latch lever 490 is in its latched, nested position, whereupon the pawl tooth formation 526 is moved, under the influence of the spring 620 into receiving engagement with the notch 498. When the pawl 520 is moved to its releasing position, as shown in FIG. 10, the tooth formation 526 is no longer received within the notch 498, whereupon the latch lever 490 is released to move under the influence of the spring 590 away from its latched, nested position toward its unlatched, extended position.

The spring 620 has a coiled portion 622 which is reeved around the shaft 460, as elongate end portion 624 which is engageable with the abutment formation 524, and an elongate end portion 626 which engages the back wall portion 438. The spring 620 operates the bias the pawl 520 away from its releasing position toward its retaining position.

The tool-operated actuator 610 has a generally cylindrical central portion 612, a reduced-diameter head portion 614, and a mounting projection 616. A cam member 630 is carried on the mounting projection 616. The head portion 614 extends through and is journaled by the door panel hole 424. A tool-receiving formation 690 in the form of a specially configured cavity opens through the outer surface of the head portion 614.

The mounting projection 616 extends through the actuator mounting hole 470, through a hole 632 formed through the cam member 630, and is crimped to provide an enlarged head which will retain the actuator member 610 and the cam member 630 in place relative to the body 430 while permitting the actuator member 610 to rotate about an axis defined by the mounting hole 470. The axis defined by the mounting hole 470 extends substantially orthogonally with respect to the axes of the parallel-extending shafts 454, 456, 458, 460 (i.e., the axis of the hole 470 extends in a plane which perpendicularly intersects the parallel axes of the shafts 454, 456, 458, 460).

The portion of the mounting projection 616 which extends through the mounting hole 470 has a cylindrical outer surface which slip fits within the hole 470. The portion of the mounting projection 616 which extends through the cam member hole is of square configuration, as is the cam member hole 632 (these interfitting squares being indicated by the numeral 628 in FIGS. 7 and 9), whereby a driving connection is formed between the mounting projection 616 and the cam member 630.

The cam member 630 has a generally trapezoidal shape and includes a cam surface 640 which is engageable with the pawl abutment formation 524. An abutment surface 642 is formed on the opposite side of the cam member 630 from the cam surface 640 and its opposite end regions are selectively engageable with the stop projection 441 depending on which direction the actuating member 610 is rotated, as is shown in solid and phantom lines in FIG. 9, whereby the extremes of movement of the actuating member 610 are defined. When the actuating member 610 is in its locked position, as shown in FIGS. 7 and 8, the cam surface 640 permits the pawl 520 to assume its retaining position under the influence of the spring 620. When the actuating member 610 is rotated to either of its unlocked positions, the abutment surface 642 engages the stop projection 441 and the cam surface 640 engages the abutment formation 524 causing the pawl 520 to pivot to its releasing position in opposition to the action of the spring 620. When the cam member 630 has been rotated out of its normal position (shown in FIG. 7), the spring 620 operating through the pawl 520, biases the cam member 630 back toward its normal position.

A feature of the latch 410 lies in the manner in which the axis of the actuator 610 is fixed with respect to the door panel 412. One end portion of the actuator 610 is journaled by the body mounting hole 470. The other end region of the actuator member 610 is journaled by the door panel hole 424. This simple and effective mounting system not only fixes the rotation axis of the actuator 610 relative to the door panel 412, but also utilizes the door panel 412 on which the latch 410 is mounted to assist in securely supporting and journaling one end of the actuator 610. When an Allen wrench 800 or other suitably configured tool (not shown) is introduced into the tool-receiving formation 690 or other suitably configured formation (not shown), and is operated to move the actuator 610 from its locked position to its unlocked position, the axis of movement of the actuator 610 does not change relative to the door panel 412.

A further feature of the present invention lies in the manner in which the latch lever 490 and the door panel 412 cooperate to shield the pawl 520 from unauthorized access. When the latch lever 490 is in its latched, nested position, it is closely received within the door panel opening 422 so that the pawl 520 is shielded from unauthorized access.

As will be apparent from the foregoing description, the present invention provides a rugged, easy to assemble, inexpensive to manufacture, flush-mountable, tool-operable, lever-acting latch. A body formed from a single piece of stamped metal supports the latch lever, the pawl and the actuator for pivotal movement about separate axes. Two torsion coil springs each operate independently on associated ones of the pivotally mounted members.

While the latch 410 has been described and illustrated as being mounted on a hinged door panel, it will be understood that latches embodying the spirit of the present invention can be employed in a wide variety of applications wherein access panels, electrical enclosure components and the like are to be retained in particular relationships to other components. Accordingly, where the term "door panel" is used, it will be understood to refer to a wide range of similar components and shall not be construed as being limited to a hinged door.

Although the invention has been described in its preferred form with a certain degree of particularity, it is understood that the present disclosure of the preferred form has been made only by way of example and that numerous changes in the details of construction and the combination and arrangement of parts may be resorted to without departing from the true spirit and scope of the invention as hereinafter claimed.

What is claimed is:

1. A flush-mountable, tool-operable latch suitable for mounting on a door panel or the like to releasably retain the door panel in a closed position, comprising:

(a) a body having wall portions which define an elongate, forwardly-facing recess, and having mounting formation means on opposite sides of the recess for mounting the body on a door panel with the forwardly-facing recess aligned with an elongate opening formed through the door panel;

(b) an elongate latch lever pivotally connected to the body and having:

(i) a strike-engaging formation which is movable between a latched position wherein it is engageable with a strike for retaining the door panel in a closed position, and an unlatched position wherein the strike-engaging formation is withdrawn to permit the door panel to move from its closed position to an open position; and, (ii) an elongate operating formation which is movable between a nested position relative to the forwardly-facing recess, and an extended position relative to the recess, the operating formation being configured to reside (1) in its nested position when the strike-engaging formation is in its latched position, and (2) in its extended position when the strike-engaging formation is in its unlatched position;

(c) a pawl pivotally connected to the body for movement between a retaining position wherein it engages the latch lever to releasably retain the latch lever with its formation in their nested, latched positions, and a releasing position wherein the pawl releases the latch lever thereby permitting the latch lever formations to be moved to their unlatched, extended positions;

(d) a tool-operable actuator connected to the body for movement between locked and unlocked positions, including:

(i) tool-receiving means for receiving a specially configured tool and being operable to move the actuator in response to movement of such received tool; and, (ii) a cam surface which operably connects with the pawl, which permits the pawl to assume its retaining position when the actuator is in its locked position, and which effects movement of the pawl to its releasing position when the actuator is moved to its unlocked position;

(e) first biasing means for biasing the latch lever away from its latched, nested position, toward its unlatched, extended position; and, (f) second biasing means for biasing the pawl away from its releasing position toward its retaining position.

2. The latch of claim 1 wherein the second biasing means is also operative to bias the tool-receiving means toward its locked position when the tool-receiving means has been moved away from its locked position toward an unlocked position.

3. The latch of claim 1 wherein the latch lever and the pawl are pivotal relative to the body about spaced, parallel axes.

4. The latch of claim 3 wherein the actuator is rotatably connected to the body for rotation about an axis which extends in a plane that is perpendicular to the parallel pivot axes of the latch lever and the pawl.

5. The latch of claim 4 wherein the actuator has spaced formation means for journaling the actuator in aligned holes formed through the body and the door panel.

6. The latch of claim 1 wherein the actuator includes:

(a) a generally cylindrical portion wherein the tool-receiving means is provided in the form of a specially configured cavity;

(b) a transversely extending portion having the cam surface formed thereon; and, (c) a mounting formation connecting the cylindrical and transversely extending portions, and being journaled by a hole formed through the body.

7. The latch of claim 1 additionally including third biasing means biasing the actuator from its unlocked position toward its locked position.

8. A flush-mountable, tool-operable latch suitable for mounting on a door panel or the like which has an elongate opening formed therethrough, to releasably retain the door panel in a closed position, comprising:

(a) structure defining a body configured to extend rearwardly from the backface of a door panel on opposite sides of an elongate opening formed through the door panel;

(b) an elongate latch lever pivotally connected to the body and being movable between extended and nested positions with respect to the door panel opening, and being operable to move a strike-engaging formation between latched and unlatched positions for selectively releasably retaining the door panel in a closed position;

(c) a pawl connected to the body for movement between retaining and releasing positions for selectively releasably retaining the latch lever in its nested position; and, (d) a tool-operable actuator supported on a selected one of the structures for movement relative thereto between locked and unlocked positions in response to movement of a tool which is drivingly received by the tool-operable actuator, the actuator being operable to permit positioning of the pawl in its retaining position when the actuator is in its locked position, and being operable to position the pawl in its releasing position when the actuator is in its unlocked position.

9. The latch of claim 8 wherein the tool-operable actuator is journaled by the body and by the door panel for movement between its locked and unlocked positions.

10. The latch of claim 8 additionally including biasing means for:

(a) biasing the latch lever away from its nested position toward its extended position; and (b) biasing the pawl away from its releasing position toward its retaining position.

11. The latch of claim 10 additionally including further biasing means for biasing the actuator away from its unlocked position toward its locked position.

12. The latch of claim 8 wherein the actuator includes structure defining a cam surface which is operably coupled with the pawl to permit the pawl to assume its retaining position when the actuator is in its locked position, and which effects movement of the pawl to its releasing position when the actuator is moved to its unlocked position.

13. The latch of claim 8 wherein:

(a) a stop formation is provided on the body; and, (b) the structure defining a cam surface is additionally provided with a pair of abutment surface portions configured to selectively engage the stop formation.

14. The latch of claim 13 wherein the actuator is rotatable in a single direction from its locked position toward its unlocked position, and one of the surface portions engages the stop formation when the actuator is in its locked position, while the other of the surface portions engages the stop formation when the actuator is in its unlocked position.

15. The latch of claim 13 wherein the actuator is rotatable in either of two directions in moving selectively from its locked position to either of two unlocked positions, and one or the other of the surface portions selectively engages the stop formation when the actuator is in one or the other of its unlocked positions.

16. The latch of claim 15 additionally including biasing means for biasing the pawl toward its retaining position and for biasing the actuator toward its locked position.

* * * * *